United States Patent [19]

Hendricks van de Weem

[11] Patent Number: 5,043,189

[45] Date of Patent: Aug. 27, 1991

[54] METHOD AND APPARATUS FOR PLACING A CODE ON TEXTILE WEBS

[75] Inventor: Johannes G. M. Hendricks van de Weem, Helmond, Netherlands

[73] Assignee: Vlisco B.V., PH Helmond, Netherlands

[21] Appl. No.: 390,654

[22] Filed: Aug. 7, 1989

[51] Int. Cl.[5] ..... B05D 5/00; B05C 1/16

[52] U.S. Cl. ..... 427/288; 118/211; 118/221; 118/247

[58] Field of Search ..... 118/221, 247, 211; 427/288, 132

[56] References Cited

U.S. PATENT DOCUMENTS

| | | | |
|---|---|---|---|
| 2,586,905 | 2/1952 | Bates | 156/542 |
| 4,020,194 | 4/1977 | McIntyre et al. | 118/247 X |
| 4,246,032 | 1/1981 | van den Heuvel | 106/19 |
| 4,277,301 | 7/1981 | McIntyre et al. | 118/247 X |

FOREIGN PATENT DOCUMENTS

| | | |
|---|---|---|
| 163162 | 10/1975 | Netherlands . |
| 3495 | 2/1915 | United Kingdom . |

OTHER PUBLICATIONS

"The American Heritage Dictionary of the English Language", New College Edition, Hughton Mifflin Co., 1981, p. 959.

*Primary Examiner*—Evan Lawrence

*Attorney, Agent, or Firm*—Amster, Rothstein & Ebenstein

[57] ABSTRACT

A method and an apparatus for applying a code to textile webs in the form of detectable dots of iron-containing paste. The moving textile web (1) is passed over an iron-containing paste (3) placed on a movable support (2). A series of dots is formed on the textile web by passing the textile web (1) briefly into the paste (3) by means of vertically movable cogs (5) disposed above the textile web (1).

8 Claims, 3 Drawing Sheets

METHOD AND APPARATUS FOR PLACING A CODE ON TEXTILE WEBS

This invention relates to a method and apparatus for placing a code on textile webs in the form of detectable dots of iron-containing paste.

The placing of a single dot of iron-containing paste on a textile web is known from Dutch patent 163,162. The single dot is used as a so-called marking dot and is not a code, which in the present case is construed to mean a relatively long series of dots which in binary form may represent some large numbers, such as code numbers, order numbers and other references. The provision of such a code along the edges of a moving textile web to be subjected to a number of operations makes for better control of the production process.

To that effect, the method of the present invention is characterized by passing the moving textile web over an iron-containing paste on a movable support, and forming a series of dots on the textile web by briefly pressing the textile web into the paste by means of vertically movable cogs disposed above the textile web.

Apparatus for applying this method is characterized, according to the present invention, by a rotary paste wheel arranged underneath a path to be traversed by a movable textile web, a dosing device for applying an iron-containing paste to a portion of the periphery of the paste wheel, a rotary hollow shaft provided above, and spaced from, said path for the movable textile web, said shaft including a series of electromagnets arranged one behind another in the center thereof, and each connected to a tiltable cog projecting from the shaft, said cog being arranged, upon energization of the associated magnet to press the textile web briefly against the paste wheel to form a detectable dot on said web.

One embodiment of the method and the apparatus according to the present invention will now be described, by way of example, with reference to the accompanying drawings, in which:

FIG. 1 diagrammatically shows the method and apparatus according to the present invention;

The starting point for the code to be placed is a code of maximally 25 signs, which may have a maximum interspace of 2 cm, so that the length of the total code is maximally 50 cm. The code may be applied on one edge or on both edges of the advancing fabric in a narrow margin. The speed of advance of the fabric ranges between 0 and 120 m per minute.

Figure 1:
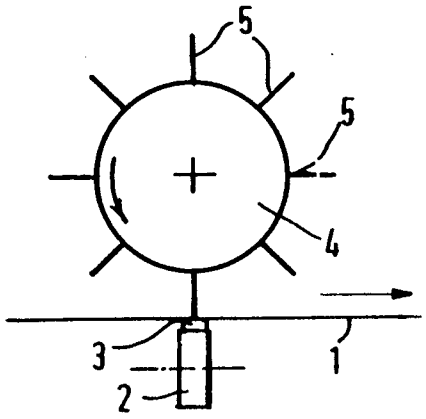

FIG. 1 diagramatically shows the method and apparatus according to the present invention. A fabric or textile web 1 advancing in the direction of the indicated arrow is moving just above a quantity of iron-containing paste 3 applied to the periphery of a paste wheel 2. Above the path for textile web 1, there is provided a hollow shaft 4 having a plurality of tiltable cogs 5 projecting from its periphery. The cog being provided above the paste wheel 2 can be momentarily moved vertically downwards, whereby the advancing fabric 1 is pressed at the underside into the paste 3. The hollow shaft 4 rotates in the direction indicated by the arrow at a slightly higher peripheral speed than the horizontal speed of advance of fabric 1. Each tiltable cog 5 will therefore pass the paste 3 present underneath fabric 1, and when energized in that position will cause a detectable dot to be placed on the underside of the fabric. If 25 tiltable cogs should be provided on the periphery of hollow shaft 4, only one revolution of hollow shaft 4 would be necessary for placing one code on the advancing fabric 1. For practical reasons, it is better to choose thirteen tiltable cogs 5 projecting from the hollow shaft, which means that hollow shaft 4 has to make two revolutions for one complete code to be printed on fabric 1.

Figure 2:
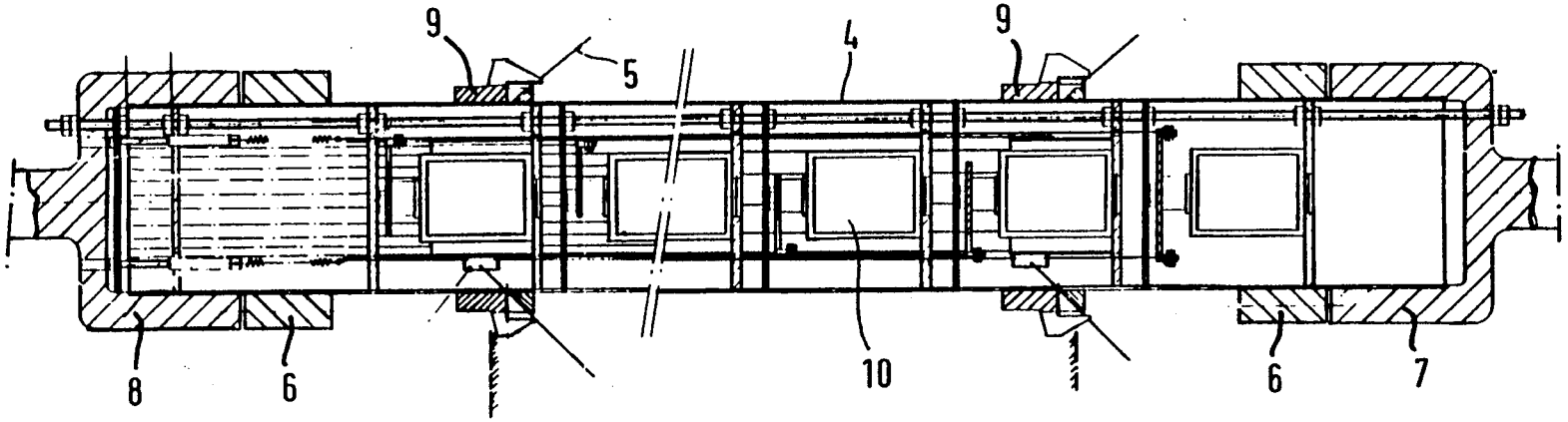
FIG. 2 is a longitudinal sectional view of the encoding shaft.

FIG. 2 is a longitudinal sectional view of hollow shaft 4 shown in FIG. 1, near the two ends, hollow shaft 4 is provided with a ring 9 of cogs which are controlled by electromagnets 10 mounted one behind the other around the axis of the hollow shaft 4. Each magnet 10 is adapted to operate one tiltable cog 5 of both the left and the right ring 9 of cogs at a certain point of time.

Figure 3:
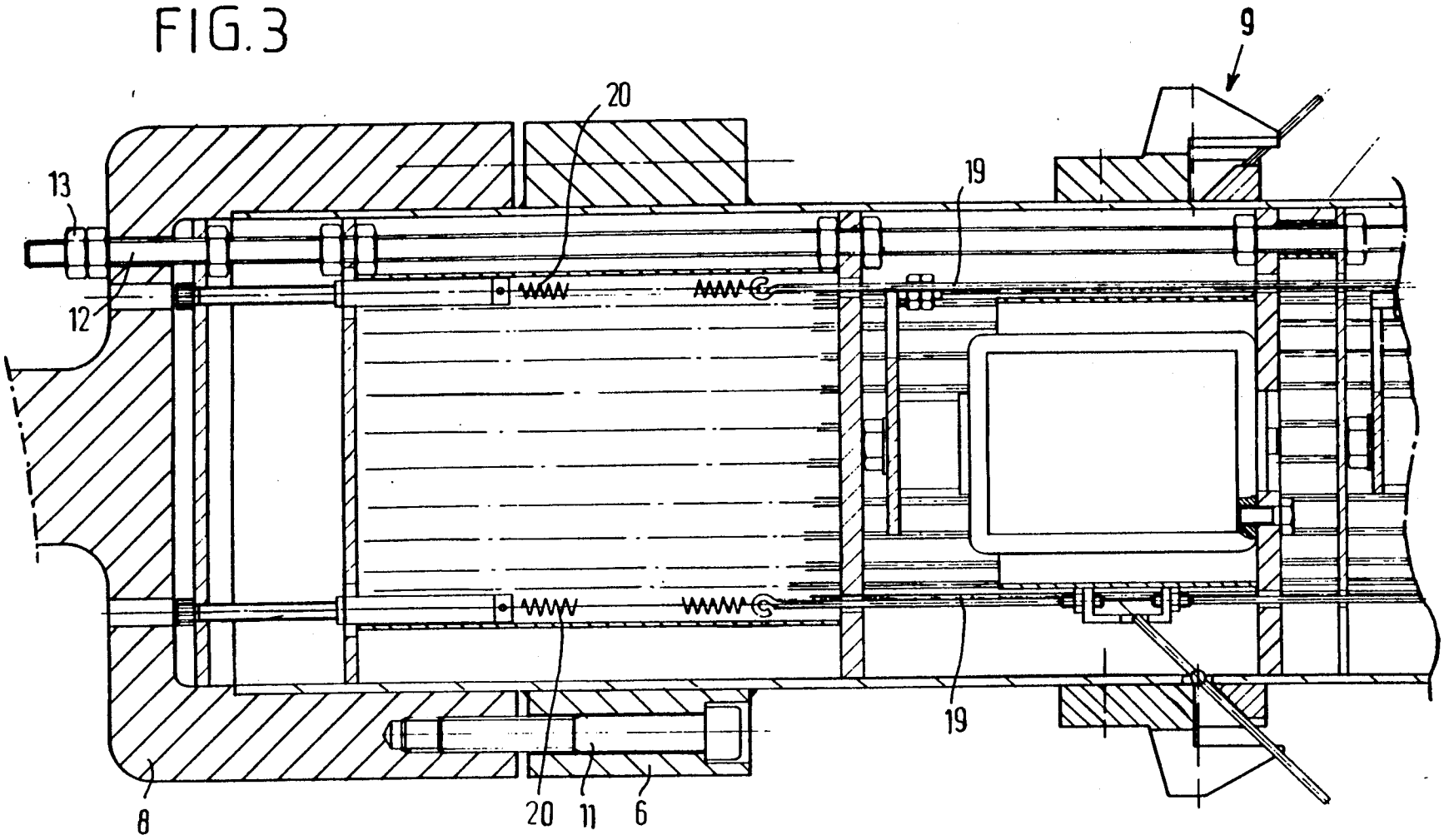
FIG. 3 shows, on an enlarged scale, the left-hand portion of the encoding shaft shown in FIG. 2.
Figure 4:
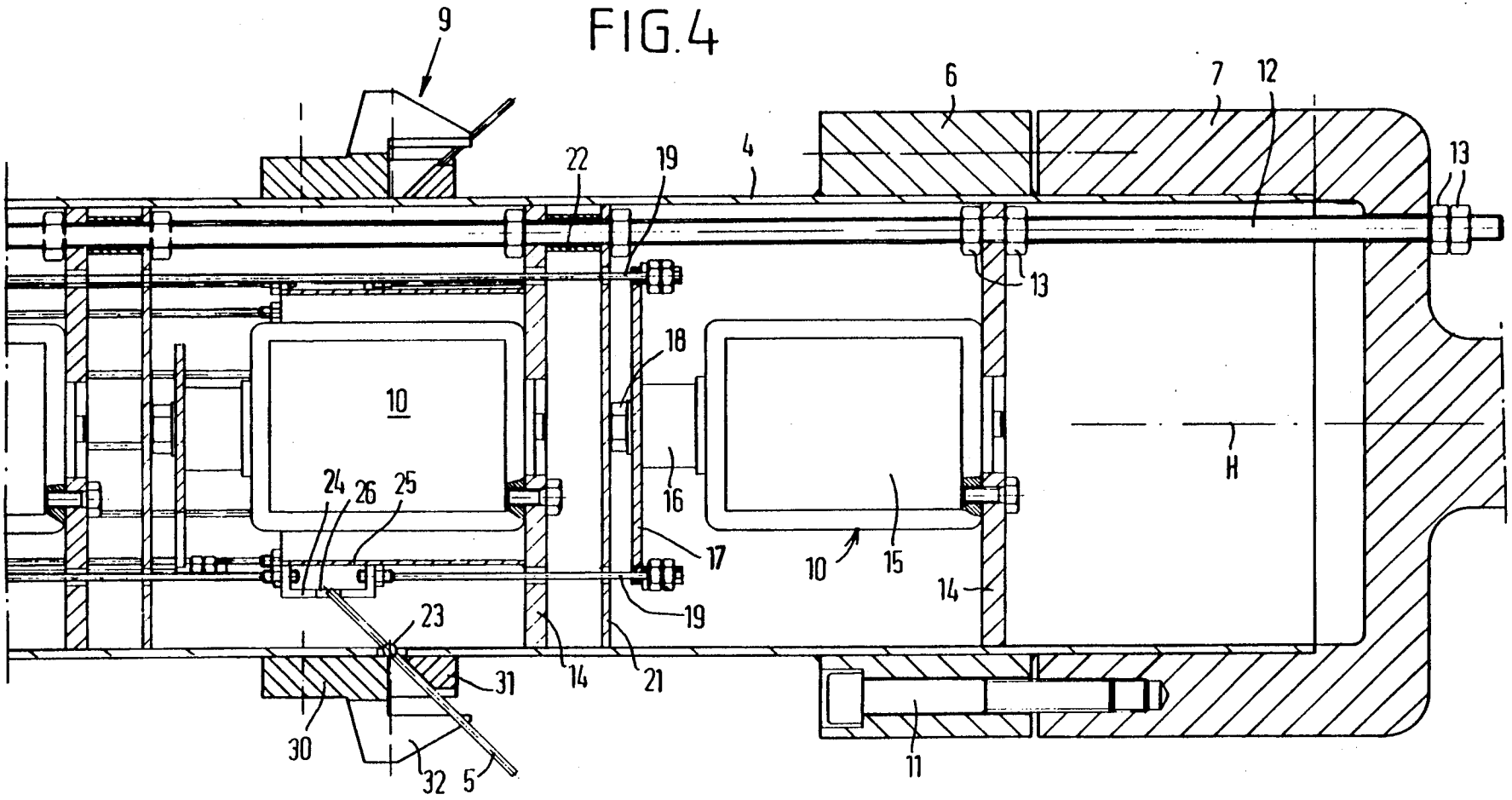
FIG. 4 shows, on an enlarged scale, the right-hand portion of the encoding shaft shown in FIG. 2.

The two ends of the hollow shaft 4 illustrated in FIG. 2 are shown on an enlarged scale in FIGS. 3 and 4. Hollow tube 4 is a seamless precision tube to whose ends a ring 6 is welded. Said ring serves for installing closing heads 7 (right-hand side) and 8 (left-hand side) on tube 4 by means of the connection bolts 11. The ends of closing heads 7, 8, as shown in FIG. 2 are provided with stub shafts for shaft 4 to be mounted in bearings and to be driven. Projecting furthermore from closing heads 7/8 are the ends of three threaded rods 12, one being shown in FIGS. 3 and 4. The threaded rods are secured on the outer side of closing heads 7, 8 with nut and lock nut 13, while within hollow shaft 4, partitions 14 are secured to rods 12, said partitions 14 serving for mounting electromagnets 10 thereon. These magnets are all mounted in such a manner that their axes coincide with the axis H of the seamless precision tube 4. The coil 15 of magnet 10 is mounted with screws on the first partition 14 situated at the right-hand side thereof. The core 16 projecting from coil 15 on the left-hand side carries a yoke 17 secured to said core 16 with a bolt 18. Attached to the end of the yoke, both at the top and at the bottom, are draw rods 19 connected at the other end (see FIG. 3) to tension springs 20 biasing said rods 19. In order to maintain core 16 exactly in position, a second partition 21 is placed on rods 12 parallel to each partition 14 (except for the partition farthest on the right) by means of spacing sleeves 22. Tension springs 20 and draw rods 19 urge the movable core 16 of an electromagnet 10 in de-energized state against partition 21.

One of the draw rods 19 comprises a bow-shaped member 24 provided with an opening 26, into which extends the end of a tiltable cog which, at 23, is fitted pivotally in the wall of tube 4. Beyond pivot point 23, cog 5 projects from the wall of tube 4. The end of cog 5 is bent in approximately horizontal direction (not shown). It is clear that upon energization of coil 15, core 16 is pulled into coil 15, thereby moving the draw rods 19 connected to said core 16 to the right. The cog 5 inserted into bow 24 will then tilt about pivot point 23, so that the end of cog 5 projecting from tube 4 is moved downwards, thereby pressing the fabric situated underneath said cog into a paste 3 in the above described manner, so as to form a detectable dot on the textile web. As shown in FIG. 3 draw rod 19 includes a second bow 24 at the location of the second ring 9 of cogs near head 8 of hollow shaft 4. The second bow is adapted to tilt an associated tiltable cog in exactly the same manner as described above, allowing an identical code to be applied to both sides of the advancing textile web.

Each ring 9 of cogs comprises thirteen tiltable cogs 5, the pivot points 23 of which are situated on a circumferential circle of hollow tube 4. For obtaining a proper retention and guidance of said thirteen tiltable cogs 5, there is provided on the hollow tube 4, at the pivot points 23, a toothed wheel 30 having thirteen teeth 32 extending both radially and axially. The tiltable cogs 5 are guided in their tilting movement by the side face of a projecting tooth 32. On the other side of the circumferential circle, passing through pivot points 23, there is provided a counter wheel 31, having thirteen recesses with a slanting face pointing in the direction of the tiltable cog 5 in the starting position. The side walls of the recesses likewise provide for guidance of cog 5 during its tilting movement.

Each of the thirteen tiltable cogs 5 constituting a ring is controlled by its own electromagnet 10 by means of draw rods 19 and bows 24 provided therein. The thirteen bows 24 are slidable on, and along, a cylindrical sleeve or bush 25, which is disposed within hollow tube 4 adjacent to the ring 9 of cogs, beyond the electromagnet 10 present at the level of the row of cogs.

The hollow shaft 4 comprises in principle thirteen identical chambers located one behind the other and each containing an electromagnet 10. The partitions provided between the chambers, such as partitions 14 and 21, are all passed by twenty-six draw rods 19, every pair of which are associated with a given electromagnet, and hence with a given tiltable cog.

I claim

1. A method of applying a code to textile webs in the form of detectable dots of an iron-containing paste, characterized by passing the moving textile web over an iron-containing paste on a movable support, and forming a series of dots on the textile web by pressing the textile web briefly into the paste by means of cogs disposed on a shaft above the textile web and vertically movable relative to the shaft.

2. Apparatus for applying the method as claimed in claim 1, characterized by:

a rotary paste wheel arranged underneath a path to be traversed by a movable textile web;

a dosing device for applying an iron-containing paste to a portion of the periphery of the paste wheel and;

a rotary hollow shaft mounted above, and spaced from, said path for the movable textile web, said hollow shaft including a series of electromagnets arranged one behind the other in the center thereof, and each connected to a tiltable cog projecting from shaft, said cog, being arranged, upon energization of the associated magnet, to press the textile web briefly against the paste wheel to form a detectable dot on said web.

3. Apparatus as claimed in claim 2, characterized in that the coil of each electromagnet is mounted on a partition extending perpendicularly to the axis of the hollow shaft, and the movable core of each electromagnet is connected to two diametrically opposite draw rods biased by tension springs on the end remote from the electromagnet, one of said draw rods being connected to the end of at lest one tiltable cog.

4. Apparatus as claimed in either of claims 2–3, characterized in that each tiltable cog is pivotal about a pivot point provided in the wall of the hollow shaft.

5. Apparatus as claimed in claim 4, characterized in that the pivot points of a series of tiltable cogs are situated on a circumferential circle of the hollow shaft, and that there is provided near said circle a toothed wheel having as many recesses located in radial planes as there are tiltable cogs, each recess forming a guide for the tilting movement of a cog in said radial plane.

6. Apparatus as claimed in claim 2, characterized in that the hollow shaft is provided with two groups of tiltable cogs, said groups being spaced apart such a distance as corresponds with the width of the textile web, the arrangement being such that an identical code can be placed on both edges of the textile web.

7. Apparatus as claimed in claim 3, characterized in that draw rods of one electromagnet each operate a tiltable cog of the two groups simultaneously.

8. Apparatus as claimed in any claim 3, characterized in that near each partition, for the purpose of mounting an electromagnet thereon, there is provided a second partition, parallel to the first, said second partition serving as a stop for the core pulled out of the coil of the associated magnet by spring-loaded draw rods.

* * * * *